US006062403A

United States Patent [19]

Baumann et al.

[11] Patent Number: 6,062,403

[45] Date of Patent: May 16, 2000

[54] VARIABLE ELEVATING CABIN

[75] Inventors: James A. Baumann, Orland Park; Myron Glickman, Arlington Heights; John J. Lanigan, Jr., New Lenox; John J. Lanigan, Sr., Orland Park; Daniel B. Zakula, Mokena, all of Ill.

[73] Assignee: MI-Jack Products, Inc., Hazel Crest, Ill.

[21] Appl. No.: 09/179,029

[22] Filed: Oct. 26, 1998

Related U.S. Application Data

[62] Division of application No. 08/728,081, Oct. 9, 1996, Pat. No. 5,826,734.

[51] Int. Cl.[7] ..... B66C 5/10

[52] U.S. Cl. ..... 212/291; 212/344; 414/460

[58] Field of Search ..... 212/291, 290, 212/344, 345, 343, 324, 325; 187/234, 272, 274, 755; 414/460, 461, 459; 180/89.13

[56] References Cited

U.S. PATENT DOCUMENTS

| | | | |
|---|---|---|---|
| 1,901,279 | 3/1933 | Baldwin | 187/255 |
| 2,959,310 | 11/1960 | Meister | 414/459 |
| 3,396,861 | 8/1968 | Houlton | 414/459 |
| 3,593,823 | 7/1971 | Thompson | 187/255 |
| 3,796,285 | 3/1974 | Grebenstein | 187/255 |
| 4,143,781 | 3/1979 | Lenius et al. | 414/460 |
| 4,664,230 | 5/1987 | Olsen | 187/255 |
| 5,257,891 | 11/1993 | Baumann et al. | 414/460 |
| 5,529,452 | 6/1996 | Boyles et al. | 180/89.13 |

FOREIGN PATENT DOCUMENTS

| | | | |
|---|---|---|---|
| 1157754 | 11/1963 | Germany | 212/290 |
| 6700903 | 7/1968 | Netherlands | 414/460 |

*Primary Examiner*—Thomas J. Brahan
*Attorney, Agent, or Firm*—Robert A. Brown

[57] ABSTRACT

Apparatus for the handling of truck trailers or transport containers and more particularly to an apparatus and method for a variable elevating cabin apparatus operable for controlled vertical movement within the framework of a gantry crane, wherein an operator positioned in the cabin may observe and control visual observation requirements for handling a work load from any elevation between ground level and the top of the crane.

11 Claims, 9 Drawing Sheets

FIG. 9
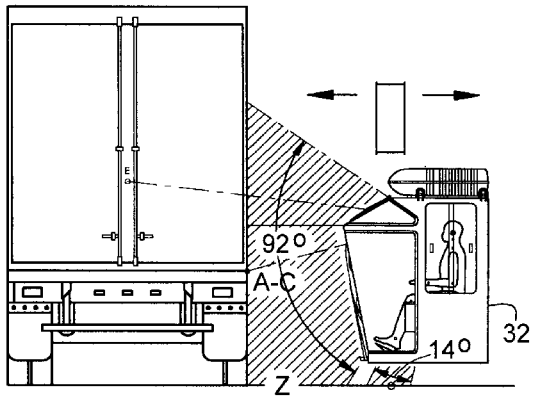
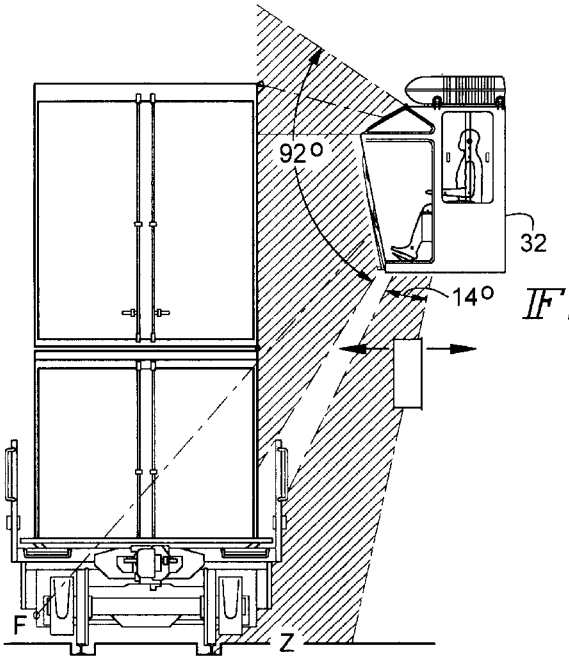
FIG. 10
FIG. 11
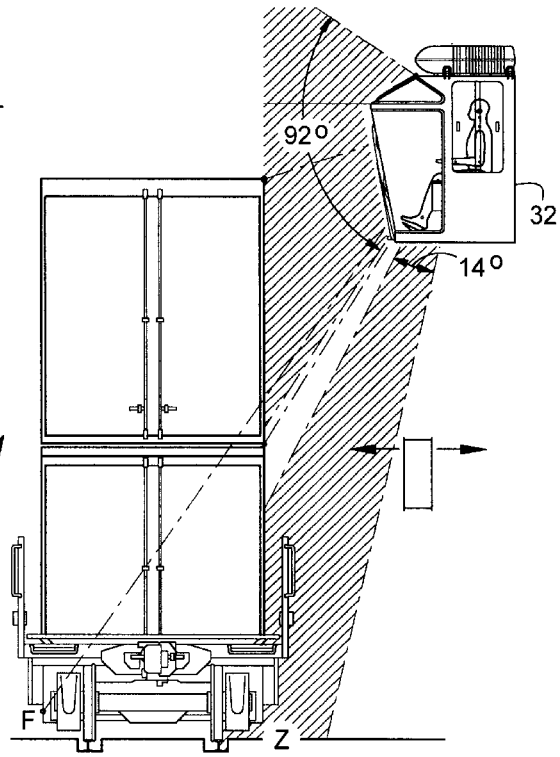

FIG. 16
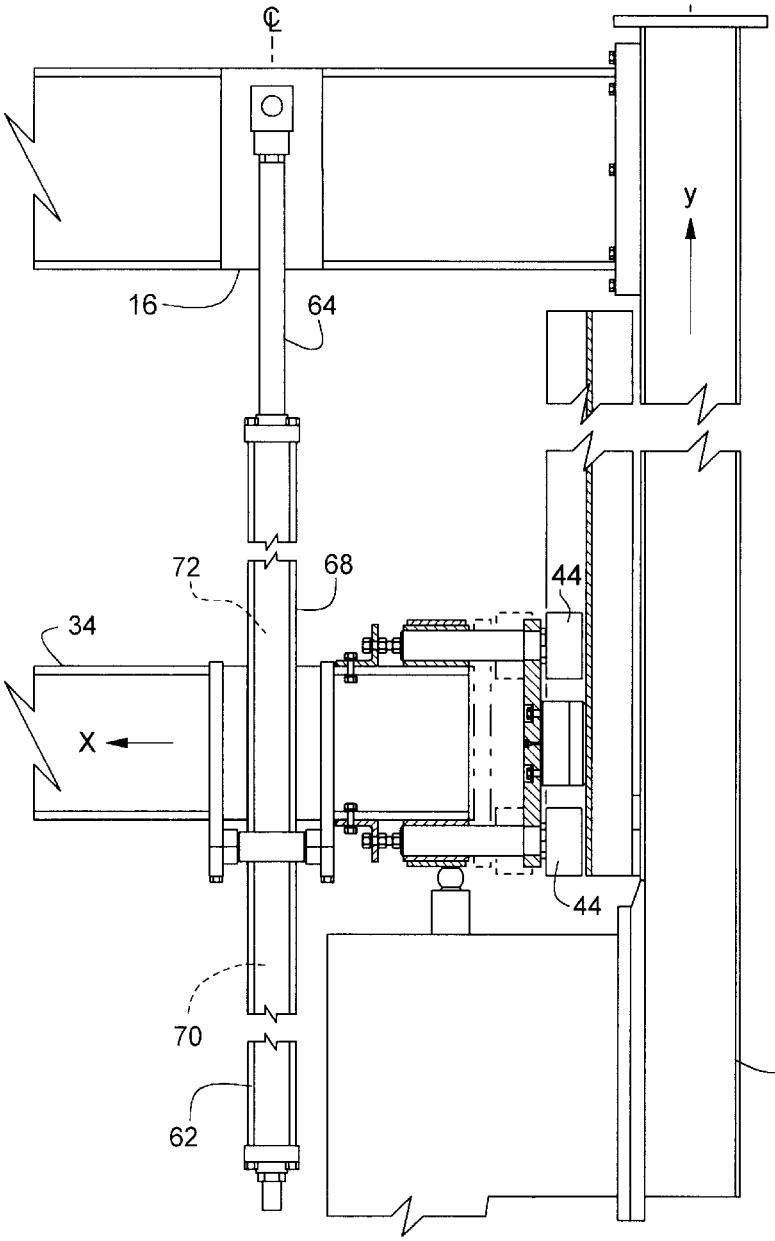
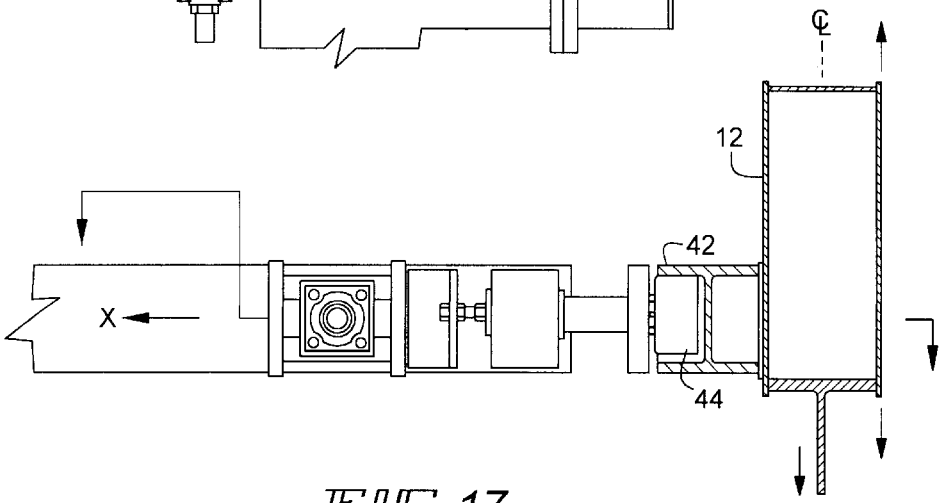
FIG. 17

VARIABLE ELEVATING CABIN

This is a division of application Ser. No. 08/728,081 filed Oct. 9, 1996, now U.S. Pat. No. 5,826,734.

BACKGROUND OF THE INVENTION

The present invention relates generally to the handling of truck trailers or transport containers and more particularly to an apparatus and method for a variable elevating cabin system for a gantry crane wherein an operator positioned in the cabin may observe and control visual operating requirements from a single location.

DESCRIPTION OF THE PRIOR ART

The transportation industry requires and uses a number of different types of tractor-trailer rigs for over the road movement of goods and products in interstate commerce. In addition, goods and products are shipped from one place to another in cargo containers mounted on railroad flat cars. Also, these containers may be transferred from flat cars into holds of ocean going vessels for transportation of goods and products to overseas destinations. In order to handle a diverse array of goods and products at a minimum cost and greatest economic benefit in shipment from one section of the country to another, or overseas, it is necessary to transfer truck trailers and/or containers intermodally, or from road to rail car, or vice versa.

The intermodal industry extensively utilizes rubber tired gantry (RTG) cranes to provide an efficient and economic means to handle trailers and containers that contain a client's products. The rapid growth of the intermodal market, however, coupled with the diverse number of products handled, such as TOFC, COFC and a variety of other products, requires an operator to keep constant surveillance of a trailer or container as it is picked up, raised or lowered within a gantry crane, transferred from one location to another and deposited at a final work station or job site. This causes considerable difficulty for an operator to perform his tasks efficiently. In order to properly control a work function, it is necessary for an operator to observe the positioning of a work load at any of many locations within the confines of a gantry crane.

In the past, manufacturers of gantry cranes have employed multiple cabins, each permanently affixed to a single location on the columns or girders of a gantry crane. For example, an operator's cabin might be disposed along a lower horizontal beam on one side of the crane, or on an upper horizontal girder at the top of the crane, or at any other single location on the structural members of the crane. Thus crane manufacturers have installed multiple cabins on cranes, one disposed on a bottom portion of the crane, or in other selected positions in between.

This practice, of course, creates other problems, such as the excessive cost to provide a plurality of cabins when only one cabin can be used at a time. Further, extra time is required for an operator to move from one cabin to another, especially when a ladder must be obtained and positioned to reach a cabin at the top of the crane. This contributes to a loss of efficiency and adds to the expense because of excessive down time and the fact that no units can be handled during this interval.

A number of attempts have been made to solve this problem. Illustrative of these attempts are U.S. Pat. Nos. 3,675,786 to Wilson; 4,858,775 to Crouch; 3,957,165 to Smith; 3,891,264 to Hunter; and 3,841,429 to Falcone. Wilson '756 discloses a vertically movable operator's cab.

Smith '165 shows an operator's cab which can be swung from up to a plurality of lowered positions. Hunter '764 discloses a selectively positionable operator cab for a load handling crane. Falcone '429 shows a straddle carrier with a cab that is slidable to selected positions. Crouch '775 discloses a vertically and horizontally movable personnel trolley for a gantry crane, but is not used as an operator's cab.

Accordingly, it would be advantageous to employ a single cabin system that would be easily moved from the bottom to the top of a crane and could be operably positioned at any point of observation therebetween. The present invention overcomes the problems of the past by providing a single cabin from which an operator can achieve all visual requirements without the need to move from one cabin to another.

SUMMARY OF THE INVENTION

Therefore, it is a primary object of the present invention to provide a cabin apparatus for controlled variable vertical movement within a side frame of a crane, comprising single cabin means operable for raising and lowering from ground level to the top of the apparatus, vertically movable horizontal beam means connected to said single cabin means and extending between a forward vertical member and a rearward vertical member of said side frame for raising and lowering said single cabin means within said side frame, first buttress beam means extending downwardly from said rearward vertical member at an oblique angle thereto, second buttress beam means extending downwardly from said forward vertical member at an oblique angle thereto, tie bar means connecting a lowermost end of said first buttress beam means to a lowermost end of said second buttress beam means, said tie bar means disposed at a lowermost position within said side frame in near proximity to ground level, whereby an operator positioned in said single cabin means has available unlimited sight lines of observation to control the raising and lowering of a work load between ground level and the top of the gantry crane.

In addition, it is a further primary object of the present invention to provide a variable elevating cabin system for a gantry crane and lift apparatus including a pair of laterally disposed portal frame means including forward and rearward corner columns for supporting a work load, wheel means secured to said portal frame means for movement thereof, upper frame beam means for connecting said forward and said rearward corner columns of each said portal frame means, upper transverse girder means for connecting respective forward corner columns and respective rearward corner columns of said pair of portal frame means, spreader means deployed from said upper transverse girder means for longitudinal and lateral movement of said work load therealong, power drive means for selectively moving said apparatus along ground level, comprising single cabin means deployed for variable vertical movement within one of said portal frame means, vertically movable horizontal beam means connected to said single cabin means and extending between said forward corner column and said rearward corner column for raising and lowering said single cabin means within said portal frame means, first buttress beam means extending downwardly from said rearward column at an oblique angle thereto, second buttress beam means extending downwardly from said forward column at an oblique angle thereto, tie bar means connecting a lowermost end of said first buttress beam means to a lowermost end of said second buttress beam means, said tie bar means disposed at a lowermost position within said portal frame means in near proximity to ground level, whereby an operator positioned in said single cabin means has available unlimited sight lines of observation to control the raising and lowering of said work load between ground level and the top of the apparatus.

BRIEF DESCRIPTION OF THE DRAWING

The foregoing and other characteristics, objects, features and advantages of the present invention will become more apparent upon consideration of the following detailed description, having reference to the accompanying figures of the drawing, wherein:

FIG. 9 is a side elevational, schematic view of a load carrying apparatus wherein a variable elevating cabin system is disposed at a lowermost location along ground level providing a wide range of vision or amplitude within a vertical plane so that an operator can easily control manipulation of a work load.

FIG. 10 is a side elevational of a load carrying apparatus wherein a variable elevating cabin system is disposed at an intermediate location between ground level and a top of a gantry crane showing a vertical amplitude of vision to enable an operator to control movement of a work load.

FIG. 11 is a side elevational view of a load carrying apparatus wherein a variable elevating cabin system is disposed at an uppermost location showing a vertical angular range of vision to enable an operator to more easily handle manipulation of a work load.

FIG. 16 is a fragmentary, schematic, elevational view of a load carrying apparatus wherein a means and method for raising and lowering a variable elevating cabin system are operable by a combination of piston rod and cylinder elements.

FIG. 17 is a fragmentary, schematic, top plan view of a load carrying apparatus as depicted in FIG. 16 wherein greater detail is shown in accordance with the present invention.

DESCRIPTION OF A PREFERRED EMBODIMENT

Figure 1:
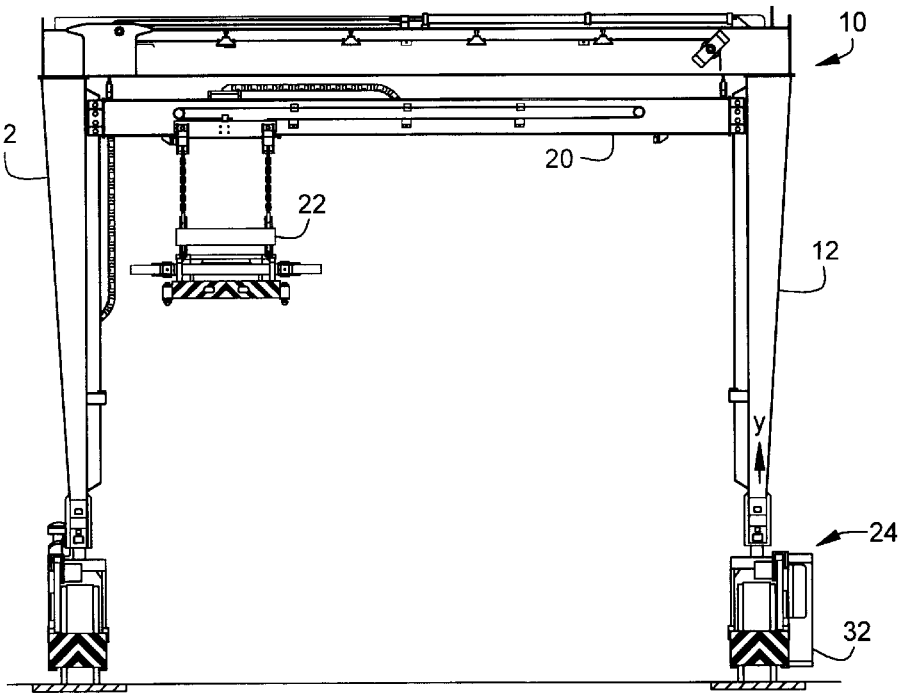
FIG. 1 is a front elevational view of a load supporting apparatus including a variable elevating cabin system operable to be raised and lowered vertically at one side of the apparatus in accordance with the present invention.

Referring now to FIG. 1. there is shown a load supporting and lifting apparatus, generally indicated by reference numeral 10, capable of directed movement along ground level and adaptable for lifting and transporting one or more of a stack of work load carrying structures, such as truck trailers or cargo containers used in intermodal roadway shipping and railroad freight car transportation applications. The apparatus 10 includes a plurality of supporting frame assemblies constructed to include horizontal beams or girders as is well known in the prior art. The lower portion of each of the laterally and oppositely disposed supporting portal frames includes a pair of upright corner columns 12 disposed on a selected number of pivotally attached wheel assemblies 14, suitably powered by drive means (not shown) for moving the apparatus along ground level. The supporting corner columns 12 may be connected fore and aft on each side by a sill beam 16 and laterally or transversely by stabilizing beams 18. Directly below the stabilizing beams 18 are a pair of girders 20 having their respective outer ends secured in suitable guide or other suitable track means for vertical movement between the bottom and top of the apparatus. A spreader mechanism 22 is deployed from the girders for transverse movement thereacross and is utilized to connect with and raise a work load from ground level so as to facilitate transportation of the work load from one location to another.

Referring to FIGS. 1–5, there is shown a variable elevating cabin system, generally indicated by reference numeral 24. As best seen in FIGS. 2, 4, 6 and 8, the cabin system 24 includes a first involution buttress beam 26, a second involution buttress beam 28 and a lower tie bar 30 connecting the bottom ends of the first buttress beam 28 and the second buttress beam 30 in a pinned or otherwise suitable assembled arrangement. Each upper end of the first and second buttress beams is bolted or otherwise suitably secured to a respective corner column 12. The buttress beams 26 and 28 along with the tie bar 30 form a cradle to receive and accommodate a variable elevating cab 32 at a lowermost position or location near ground level within the apparatus 10. The cab 32 is secured to and depends from a horizontal lift beam 34 that extends between the corner columns 12 and is operable to move vertically in suitable guide means disposed thereon.

Figure 2:
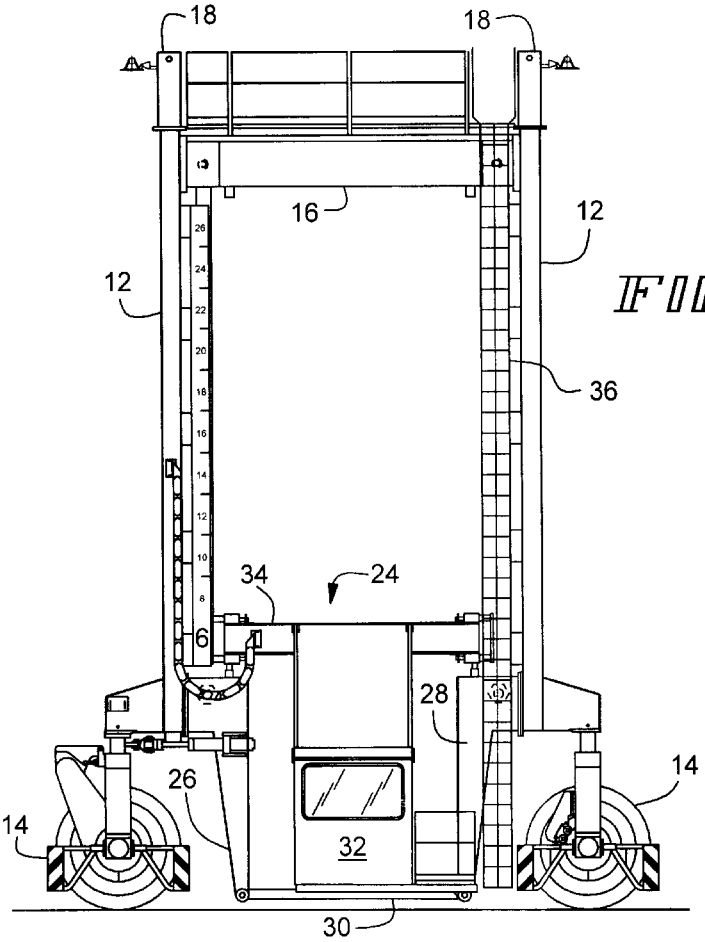
FIG. 2 is a side elevational view of a load supporting apparatus including a variable elevating cabin system disposed between a pair of corner columns of the apparatus in accordance with the present invention.
Figure 3:
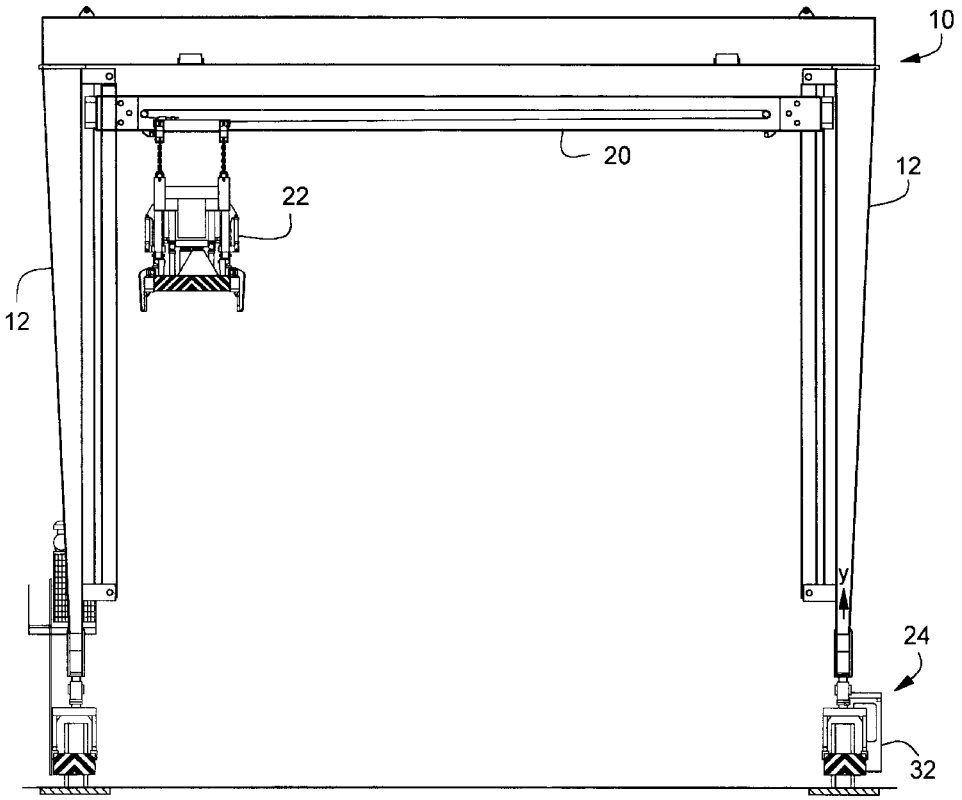
FIG. 3 is a front elevational view of a load supporting apparatus including a variable elevating cabin system similar to that shown in FIG. 1, but having a much greater height between ground level and the top of the apparatus in accordance with the present invention.
Figure 4:
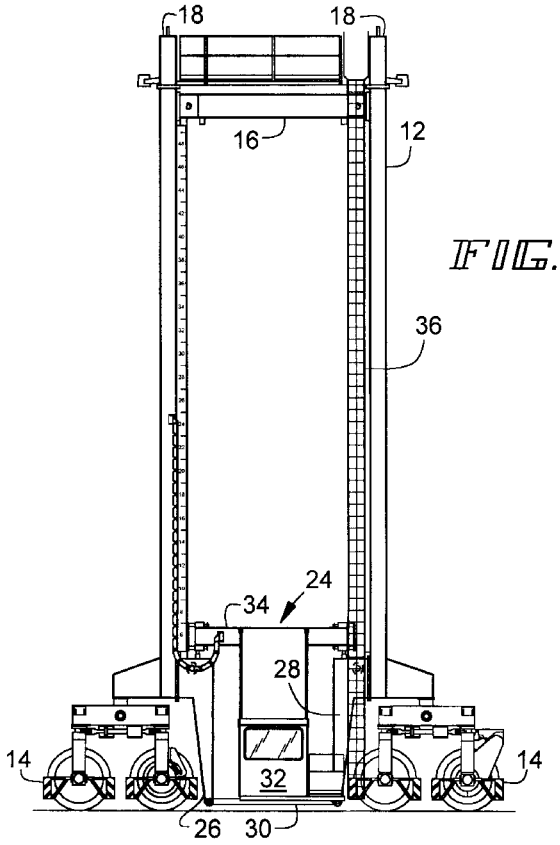
FIG. 4 is a side elevational view of a higher level load supporting apparatus as depicted in FIG. 3 including a variable elevating cabin system disposed between a pair of corner columns of the apparatus in accordance with the present invention.

In comparing the apparatus shown in FIGS. 1 and 2 with the apparatus shown in FIGS. 3 and 4, it should be noted that there is a noticeable difference in available free lift distance between ground level and the underside of the spreader 22 for handling a work load. The apparatus of FIGS. 1 and 2 can lift or handle a pay load up to a finite measurable distance above ground level, possibly in the order of 35–40 feet. The apparatus of FIGS. 3 and 4 has the capacity to lift a pay load to a significantly higher elevation above ground level than shown in FIGS. 1 and 2, in the range of 60 feet above ground level, or even higher. This characteristic becomes important, as hereinafter explained in greater detail, when the means and method of controlling the raising and lowering of the cabin system 24 are described in detail. It should be noted that in all versions of the apparatus 10, there is provided a ladder device 36 that may be utilized by an operator to descend from a cabin system that may have been disabled at the top of the apparatus. Conversely, an operator might use the ladder to ascend to a cabin system that is temporarily, for some reason or other, disposed between ground level and the top of the apparatus.

Figure 5:
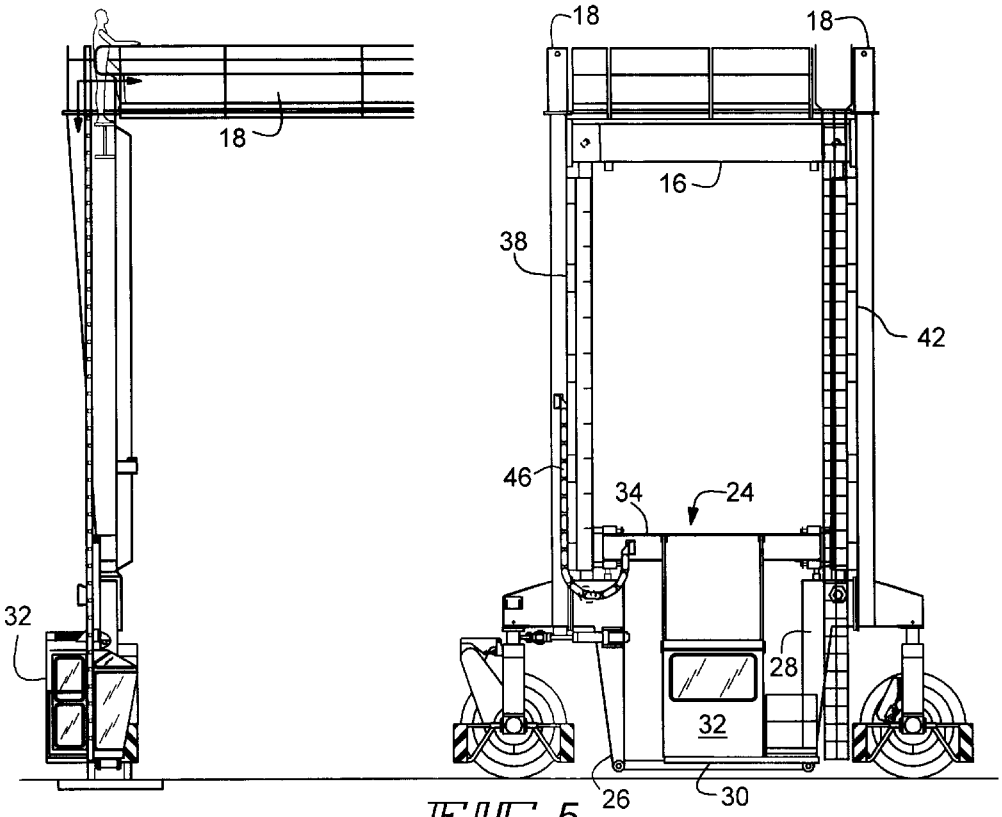
FIG. 5 is a composite partial front elevational view and a side elevational view of a load carrying apparatus wherein a variable elevating cabin system is shown at a lowermost position along ground level and operable to rise therefrom to any desired vertical position by a first means and method of operation.
Figure 6:
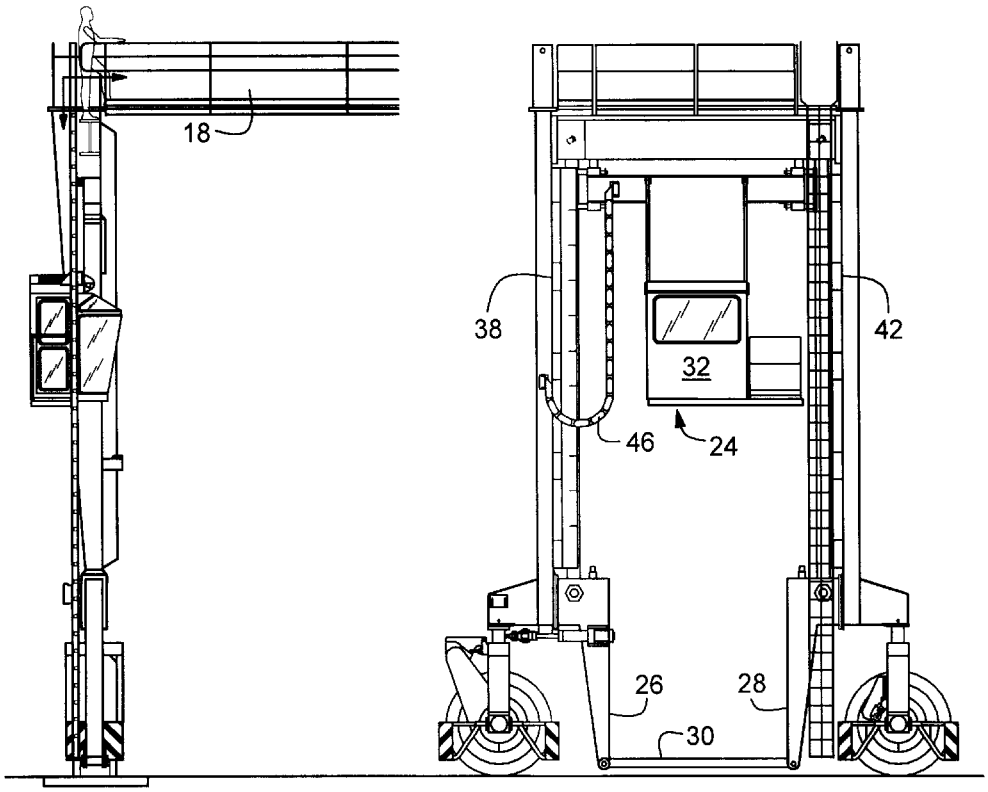
FIG. 6 is a composite partial front elevational view and a side elevational view of a load carrying apparatus wherein a variable elevating cabin system is disposed at an uppermost position from ground level and operable to be lowered therefrom to an original ground level location by the operative means and method shown in FIG. 5.
Figure 14:
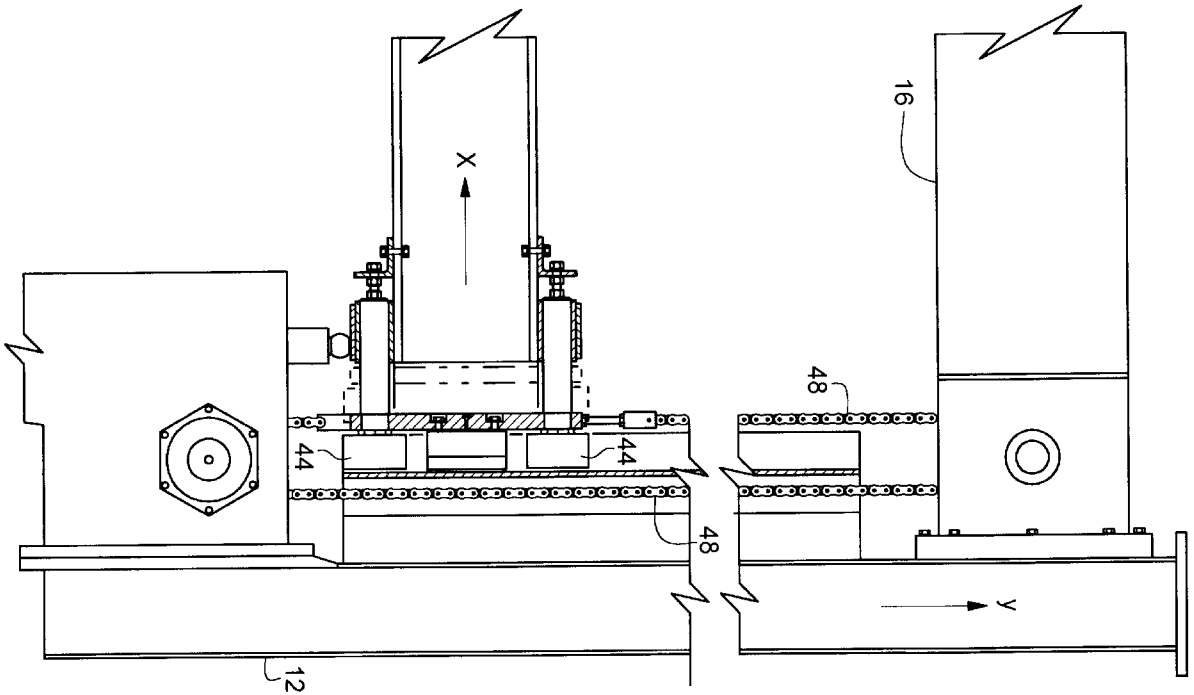
FIG. 14 is a fragmentary, schematic, elevational view of a load carrying apparatus wherein a means and method for raising and lowering a variable elevating cabin system are operable by a combination of chain and roller elements.
Figure 15:
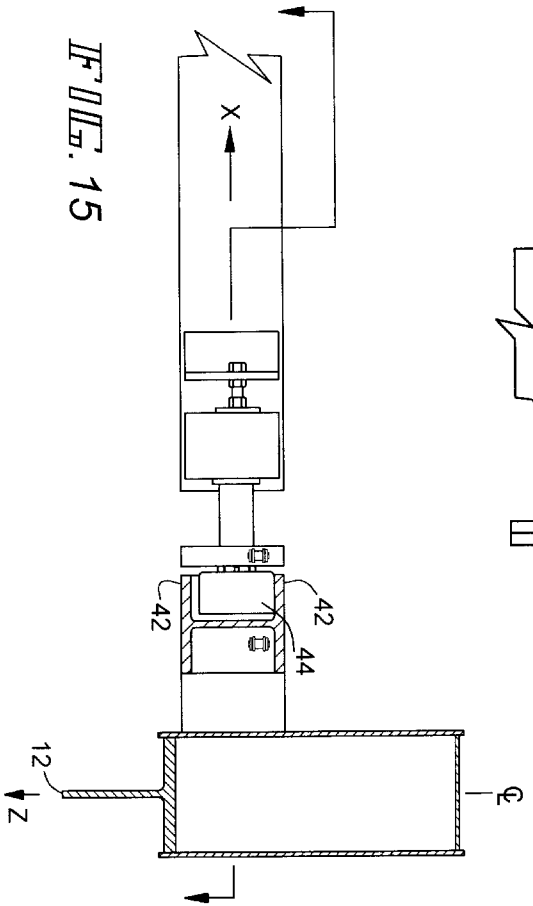
FIG. 15 is a fragmentary, schematic, top plan view of a load carrying apparatus depicted in FIG. 14 wherein greater detail is shown in accordance with the present invention.

Next referring to FIGS. 5 and 6, there is shown means for raising the cab 32 from a ground level position in FIG. 5 to an upper most level location as shown in FIG. 6. This means comprises a first roller or guide track 38 secured to a forward vertical side surface of a corner column 12 for receiving therein rectilinear movement of a series of rollers 40. The rollers 40 are suitably retained in a cage or other appropriate means affixed to a first, vertical side of the lift beam 34. Similarly, a second roller or guide track 42 is secured to a rearward vertical side surface of a corner column 12 for receiving therein rectilinear movement of a series of rollers 44. The rollers 44 are suitably retained in a cage or other appropriate means affixed to a second vertical side of the lift beam 34. The rollers 40 and 44 disposed on outer ends of the lift beam 34 and movably contained in respective guide tracks 38 and 42 are effective to permit raising and lowering of the lift beam 34 and cabin system 24 attached thereto between ground level and the top of the apparatus. The lift beam and cabin assembly is raised and lowered by electrical controls contained within a pay out cable or feed track 46. The controls located in cable 46 are effective to activate a motor and operate a first means and method of lift mechanism including a chain hoist arrangement to move the cab up and down within the confines of the apparatus. The chain hoist arrangement (See FIGS. 14 and 15) includes one end of a chain 48 connected to a top of the lift beam 34 and its depending cab 32, extends upwardly to the top of the sill beam over a conventional drive sprocket, then runs downwardly around an idler sheave, and terminates by its other end extending upwardly to connect with a bottom portion of the lift beam 34.

Figure 7:
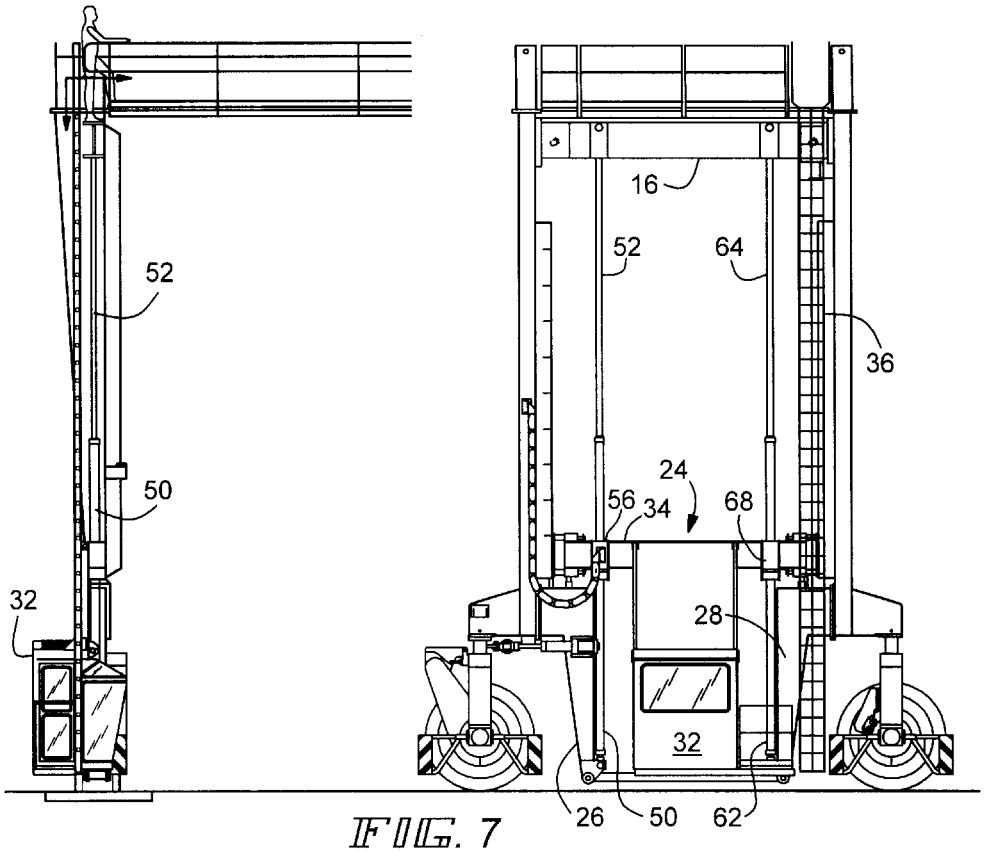
FIG. 7 is a composite partial front elevational view and a side elevational view of a load carrying apparatus wherein a variable elevating cabin system is shown at a lowermost position along ground level and operable to rise therefrom to any desired vertical position by a second means and method of operation.
Figure 8:
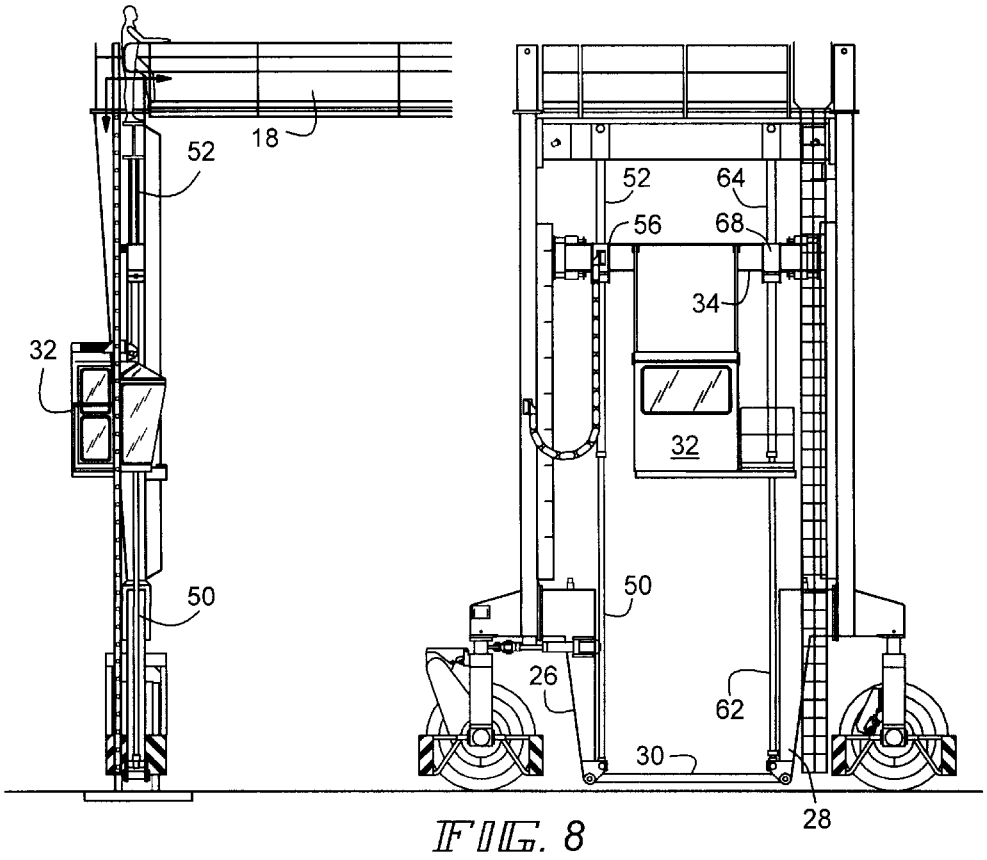
FIG. 8 is a composite partial front elevational view and a side elevational view of a load carrying apparatus wherein a variable elevating cabin system is disposed at an uppermost position from ground level and operable to be lowered therefrom to an original ground level location by the operative means and method shown in FIG. 7.

Referring now to FIGS. 7 and 8, there is shown alternate means for raising and lowering the cab 32 from a ground level position in FIG. 7 to an upper most level location in FIG. 8. This means comprises a first, elongate, continuous lower vertical rod section 50 having a first preselected diameter pinned at a lower end to a bracket or other suitable means connected to the bottom end of the first involution buttress beam 26. A first, elongate, continuous upper vertical rod section 52 having a second preselected diameter is pinned at an upper end to the upper sill beam 16. The first lower rod section 50 and the first upper rod section 52 have secured at their substantially intermediate point of juncture a first internal stationary cylinder head or plate 54 (Best seen in FIG. 18). A first double rod cylinder 56 surrounds the internal cylinder head 54 in slidable contact therewith and includes a first lower cylinder chamber or cavity 58 and a first upper cylinder chamber or cavity 60; each cavity at times receiving, expelling, and exchanging fluid therebetween as the cabin is raised and lowered in the portal side frame of the apparatus. The first cylinder head or plate 54 has formed therethrough a first bore 55, aperture or other suitable means for selectively permitting flow of fluid between the first lower chamber 58 and the first upper chamber 60. The first cylinder 56 is suitably connected to the lift beam 34 and cabin system 24 and envelops the first lower rod section 50 and first upper rod section 52 for slidable contact therealong and is effective to move the cab upwardly and downwardly on the first lower and first upper rod sections 50 and 52 by hydraulic means hereinafter explained in detail. It will be noted that the first preselected diameter of the lower vertical rod section 50 is greater than the second preselected diameter of the upper vertical rod section 52. Thus, the cross sectional area of the upper chamber 60 is greater than the cross sectional area of the lower chamber 58. Accordingly, when hydraulic fluid, or other suitable means, pressurizes the upper chamber 60, a greater force is directed against the upper side of cylinder head or plate 54, causing tension in the upper rod section 52 and moving the cab upwardly along the first upper rod section 52.

Similarly, a second elongate continuous vertical lower rod section 62 having a first preselected diameter is pinned at a lower end to a bracket or other suitable means connected to the bottom end of the second involution buttress beam 28. A second, elongate, continuous, upper vertical rod section 64 having a second preselected diameter is pinned at an upper end to the upper sill beam 16. The second lower rod section 62 and the second upper rod section 64 have secured at their substantially intermediate point of juncture a second internal cylinder head or plate 66 (Best seen in FIG. 18). A second double rod cylinder 68 surrounds the second internal cylinder head 66 in slidable contact therewith. The second double rod cylinder 68 surrounds the internal cylinder head 66 in slidable contact therewith and includes a second lower cylinder chamber or cavity 70 and a second upper cylinder chamber or cavity 72; each chamber at times receiving, expelling and exchanging fluid therebetween as the cabin is raised and lowered in the portal side frame of the apparatus. The second cylinder head or plate 66 has formed therethrough a second bore 67, aperture or other suitable means for selectively permitting flow of fluid between the second lower chamber 70 and the second upper chamber 72. The second cylinder 68 is connected to the lift beam 34 and cabin system 24 and envelops the lower and upper second rod sections 62 and 64 for slidable contact therealong and is effective to move the cab upwardly and downwardly on the lower and upper second rod sections 62 and 64 by hydraulic means hereinafter explained in detail. It will be noted that the first preselected diameter of the second lower vertical rod section 62 is greater than the second preselected diameter of the second upper vertical rod section 64. Thus, the cross sectional area of the second upper chamber 72 is greater than the cross sectional area of the second lower chamber 70. Accordingly, when hydraulic fluid, or other suitable means, pressurizes the second upper chamber 72, a greater force is directed against the upper side of second cylinder head or plate 64, causing tension in the second upper rod section 64 and moving the cab upwardly along the second upper rod section 64.

Figure 18:
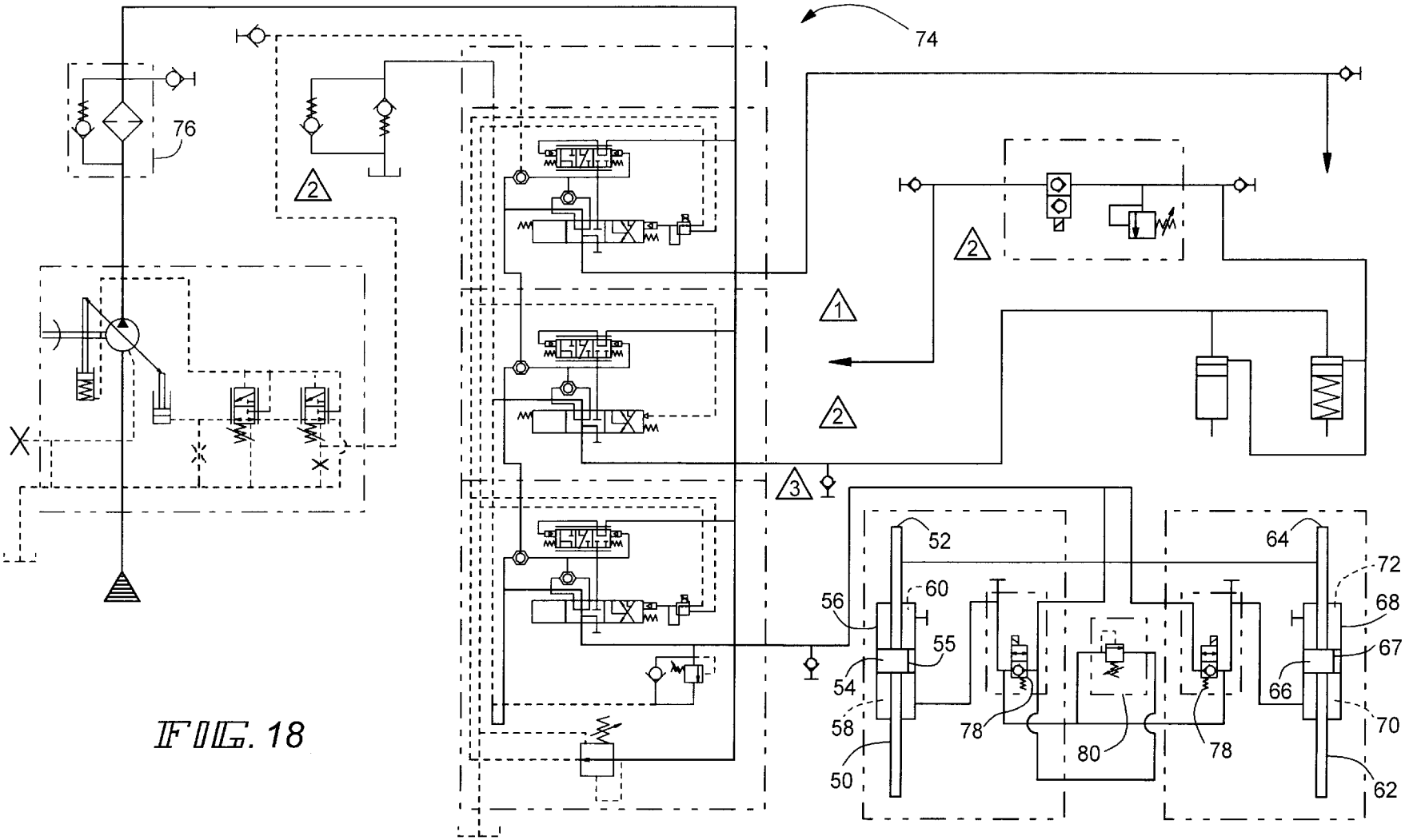
FIG. 18 is a schematic view of an hydraulic control system wherein the piston rod and cylinder elements depicted in FIGS. 16 and 17 are operable to control the raising and lowering of a variable elevating cabin system between a location near ground level and an uppermost location at the top of a load carrying apparatus.

Next referring to FIGS. 16, 17 and 18, there is shown in greater detail the hydraulic means of the present invention which is operable to raise and lower the cabin system 24 from ground level to the upper most level of the apparatus. The hydraulic system in FIG. 18, generally identified by reference numeral 74, illustrates in schematic form the manner in which pressurized fluid is supplied to a number of components of the apparatus, such as the spreader 22, brakes for the wheel assemblies 14, and the like. The system 74 also supplies pressurized fluid to the variable elevating cabin system 24 from a pump 76 through appropriate hydraulic lines to the first lower chamber 58 and to the first upper chamber 68 of the first cylinder 56; and simultaneously to the second lower chamber 70 and to the second upper chamber 72 of the second cylinder 68. It will be understood that each respective lower chamber and each upper chamber at times receives, expels and exchanges fluid therebetween so as the to raise and lower the cabin system 24 in the portal side frame of the apparatus.

The pump supplied pressurized fluid acts against the first and second cylinder heads or plates 54 and 66 to raise the cabin system to the top of the apparatus and may be maintained at that level until it is desired to lower the cabin system at a predetermined speed of descent. This operation is accomplished by the hydraulic fluid placing the first and second upper rods in tension whereby the cabin system is caused to move upwardly or downwardly therealong by preselected interchange of fluid between the lower and upper chambers of the cylinders connected to the cabin system 24. When pressure from the pump 76 is abated or by-passed to tank or sump, the weight of the cabin system will cause hydraulic fluid to flow between the upper and lower cylinder chambers and permit the lowering of the cabin system at a preselected rate of descent. It is, of course, possible to activate the pump at any time during the descent of the cabin system, either to maintain a desired level above ground level, or to move the cabin system to a higher level of observation within the side portal framework of the apparatus.

It should be noted that activation of a solenoid 78 or other suitable device may be employed to maintain fluid at a specific value to operate the cabin system at a particular elevation, resulting in bleeding of the fluid between the lower and upper cavities of the cylinders 56, 68, and thereby permit the cabin system 24 to "float" down from a elevated station above ground level. Further, there may be provided thermal relief valve means 80 set to operate at approximately 10 to 15 per cent overload above a normal operating pressure so as to direct overheated fluid to by pass an operating solenoid, and thereby open up a by-pass line to permit fluid flow directly to the sump or tank. In this instance, it will be understood that the lift beam and cabin system, because of the hereinbefore described bleed system, will achieve an equilibrium within the lower and upper chambers of the two cylinders disposed about the lower and upper rod sections and thereby maintain an equilibrium at a selected level of elevation. It should be further understood that this operation is accomplished without the need to utilize any energy from the general power plant of the apparatus.

As best seen in FIGS. 9, 10, 11, 12 and 13, there is illustrated a greatly improved arrangement for closely observing visually the position of a work load from the cabin system. In FIG. 9, the operator is able to employ a sight line that views with certainty the position of a railroad car stanchion used for tying down a truck trailer. FIG. 10 depicts the manner in which an operator can observe the entire height of two containers loaded on a railroad freight flat car. A first container may be handled by the spreader of the apparatus and loaded on the flat car. A second container can then be deployed from the spreader, moved into position and loaded on the top of the first container. All of these operations are achieved in a fast and efficient manner because of the maximum visibility provided by the unlimited vertical maneuverability of the cabin system of the present invention. In both FIGS. 10 and 11, the sight lines of the operator encompass not only the vertical height of the work load, but also range from the bottom backside to the upper back side thereof.

Figure 12:
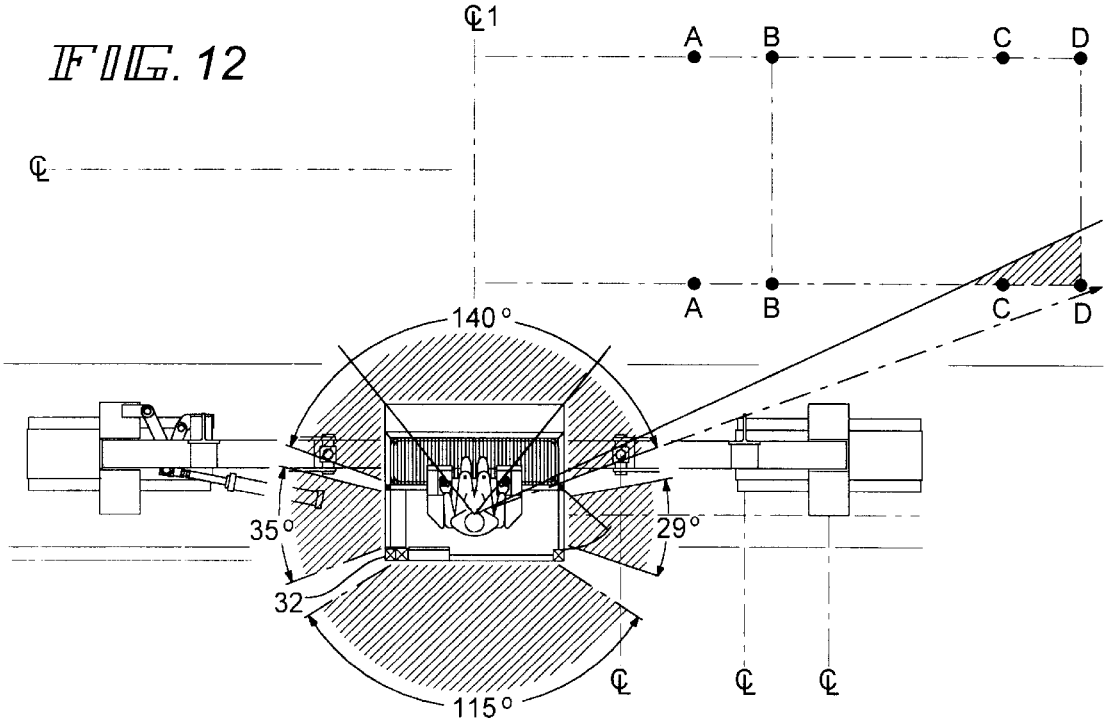
FIG. 12 is a top plan view of a load carrying apparatus wherein a variable elevating cabin system is depicted at any location along its vertical movement between ground level and the top of a gantry crane showing the advantageous manner in which an operator may observe horizontal sight lines for controlling a work piece within the apparatus.

FIG. 12 affords a top plan view of the wide range of visual capability obtained by an operator disposed within the cabin system 24. It will be understood that an amplitude up to 140 degrees of visual observation is possible from the cabin system of the present invention.

Figure 13:
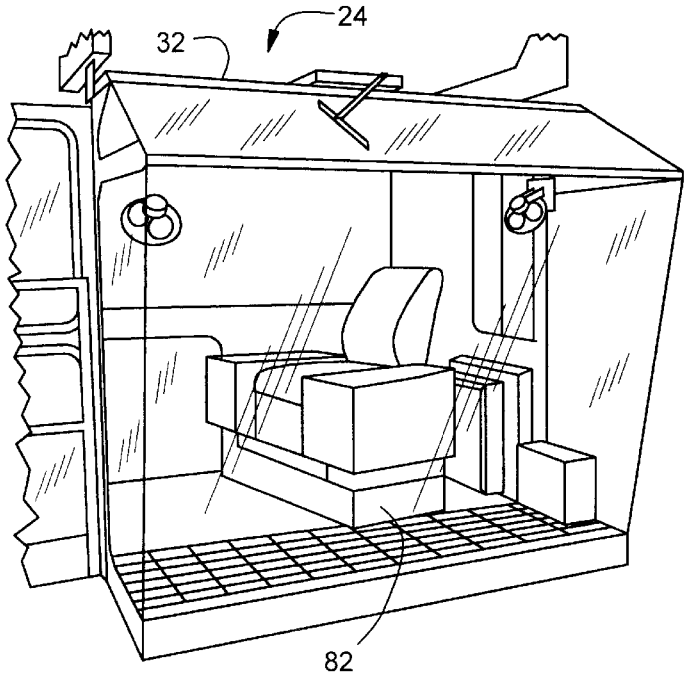
FIG. 13 is a perspective view of a variable elevating cabin system showing an operator work station with an unobstructed view for observing a work load and including a console having a plurality of controls for handling the work load.

In FIG. 13, the cab includes a console 82 operable to move fore and aft, longitudinally, laterally and rotate therein so as to provide a wide range of peripheral visibility and cover all angles of observation of a work load. In addition, the solarium style of construction of the cabin system permits visual observation and control of area and space beyond the outer structural framework, such as visibility along the runway line of trucks and containers and laterally configured dimensions of the apparatus.

In the operation of the present invention, a cabin apparatus is positioned in a cradle formed by obliquely angled first and second buttress beams tied together at their lowermost ends. A horizontal beam is secured to the cabin apparatus and is vertically movable within the confines of a portal frame of a gantry crane. The horizontal beam is raised and lowered by either a mechanical or hydraulic lift mechanism controlled by an operator positioned at a console in the cabin. The operator can move the console forward and backward, laterally and rotatably, and raise and lower the cabin so as to obtain a wide range of peripheral vision and angles of observation in handling a work load. The operator controls the attachment of a spreader assembly to a work load, raises and lowers the same, and moves the work load from one location to another to accomplish highly efficient intermodal loading and unloading of trailers, cargo containers and the like.

In the assembly of the present invention, a first buttress beam is positioned at an oblique angle to a vertical axis, a second buttress beam is positioned at an oblique angle to the vertical axis, and a tie bar is secured to and connects lowermost ends of the first and second buttress beams. Upper outward ends of each of the first and second buttress are secured to respective vertical member of a side portal frame of a gantry crane. A horizontal beam is secured to a single cabin positioned in a cradle formed by the first and second buttress beams and is operable to move vertically within the portal frame of the gantry crane. A lift mechanism is secured to the horizontal beam and to an upper sill or girder of the portal frame for raising and lowering the single cabin within the confines of the portal frame. The lift mechanism may operate mechanically, such as by a chain hoist or other suitable arrangement; or hydraulically, such as by a plurality of double rod cylinders supplied fluid from a pump through hydraulic distribution lines connected thereto and back to a tank or sump.

While the present invention has been described with reference to the above preferred embodiments, it will be understood by those skilled in the art, that various changes may be made and equivalence may be substituted for elements thereof without departing from the scope of the present invention. In addition, modifications may be made to adapt a particular situation or material to the teachings of the present invention without departing from the scope of the present invention. Therefore, it is intended that the invention not be limited to the particular embodiments disclosed for carrying out this invention, but that the present invention includes all embodiments falling within the scope of the appended claims.

What is claimed is:

1. A crane and lift apparatus including a pair of laterally disposed portal frames including forward and rearward corner columns for supporting a work load, at least one wheel secured to each of said columns for movement of said apparatus, at least one upper frame beam for connecting one each of said forward and said rearward corner columns, upper transverse girders for connecting respective forward corner columns and respective rearward corner columns of said pair of portal frames, a spreader deployed from said upper transverse girders for at least lateral movement of said work load therealong, power drive and control means for selectively moving said crane and lift apparatus along ground level, a single cabin deployed for movement throughout a substantial vertical range between one of said forward columns and a tandemly associated rearward column, said cabin having a cabin floor, at least one vertically movable horizontal cabin support mechanism connected to said single cabin and extending between one of said forward corner columns and its associated rearward corner column for raising and lowering said single cabin from ground level to the top of the apparatus, chain hoist means secured to said chain support mechanism for selective raising and lowering thereof, said chain hoist means including a chain connected at one of its ends to an outer end of said cabin support mechanism and at its other end to a lower portion of said outer end of said cabin support mechanism said chain being trained over both a drive sprocket and an idler sprocket, said sprockets and said chain being disposed adjacent opposite ends of said one of said columns associated with said cabin support mechanism, said chain hoist means also including cable means and guide track means adjacent said other column associated with said cabin support mechanism for electrically controlling operation of said chain for said raising and lowering of said cabin support mechanism, a connector assembly extending between an inside lower portion of one of said pair of forward columns and an inside portion of its associated rearward column, said connector assembly comprising a first element extending downwardly from and secured to said inside portion of said forward column and having a lower end portion positioned beneath said cabin floor when said cabin is in its lowermost position within said range of movement, said connector assembly comprising a second element extending downwardly from and secured to said inside portion of said rearward column and having a lower end portion positioned beneath said cabin floor when said cabin is in its lowermost position within said range of movement, and said connector assembly comprising a tie bar having a first end removably joined to said lower end portion of said first element and a second end removably joined to said lower end portion of said second element, whereby said cabin lies above said tie bar and beneath said upper frame beam when said cabin is within its range of movement and whereby an operator positioned in said single cabin has available substantially unlimited sight lines of observation to control the raising and lowering of said work load between ground level and the top of the apparatus.

2. A crane and lift apparatus as claimed in claim 1 wherein said cabin support mechanism comprises first and second guide tracks secured to facing vertical side surfaces of said corner columns for directed vertical movement of the single cabin, roller means disposed in distal ends of said cabin support mechanism rotatably contained in said first and second guide tracks to facilitate raising and lowering of the single cabin, and a feed track for selectively controlling the raising and lowering of said single cabin.

3. A crane and lift apparatus as claimed in claim 1 wherein said sight lines of said operator encompass an entire vertical height of said work load ranging between a lower side and an upper side thereof.

4. A crane and lift apparatus as claimed in claim 1 wherein said sight lines of said operator comprise an amplitude of 140 degrees of visual observation.

5. A crane and lift apparatus as claimed in claim 1 wherein said single cabin comprises, console means for longitudinal, lateral and rotatable movement within said single cabin so as to provide a wide range of peripheral visibility and angles of observation of said work load.

6. A crane and lift apparatus as claimed in claim 1 comprising ladder device means for an operator ascending to and descending from said single cabin disposed at any elevation between ground level and the top of the apparatus.

7. An apparatus for controlling the vertical movement of a cabin throughout a range of movement while positioned between upright columns comprising the side frame of a crane, such apparatus comprising, in combination a single cabin mounted for movement from ground level to a level adjacent the top of said crane side frame, a generally horizontal lift mechanism supporting said single cabin and extending between a forward vertical member and a rearward vertical member of said side frame for raising and lowering said single cabin within said side frame from ground level to the top of the apparatus, chain hoist means secured to said horizontal lift mechanism for selective raising and lowering thereof, said chain hoist means including a chain connected at one of its ends to an outer end of said horizontal lift mechanism and at its other end to a lower portion of said outer end of said horizontal lift mechanism, said chain being trained over both a drive sprocket and an idler sprocket, said sprockets and said chain being disposed adjacent opposite ends of a vertical member associated with said horizontal lift mechanism, said chain hoist means also including cable means and guide track means adjacent said other vertical member associated with said horizontal lift mechanism for electrically controlling operation of said chain for raising and lowering of said horizontal lift mechanism, first and second guide tracks secured to oppositely disposed facing vertical side surfaces of said forward and rearward vertical members of said side frame for directed vertical movement of the single cabin, roller means disposed in distal ends of said lift mechanism rotatably contained in said first and second guide tracks to facilitate raising and lowering of the single cabin, and feed track means for selectively controlling the raising and lowering of said single cabin.

a first buttress beam element extending downwardly from and secured to an inside portion of said rearward vertical member and terminating in a lower end portion, a second buttress beam element extending downwardly from and secured to an inside portion of said forward vertical member and terminating in a lower end portion, a tie bar removably secured to said respective lower end portions of said buttress beam elements, said tie bar disposed at a lowermost position within said side frame in near proximity to ground level, whereby an operator positioned in said single cabin has available substantially unlimited sight lines of observation to control the raising and lowering of a work load between ground level and the top of the crane.

8. A cabin apparatus as claimed in claim 7 comprising a ladder device for an operator ascending to and descending from said single cabin disposed at any elevation between ground level and the top of the apparatus.

9. A cabin apparatus as claimed in claim 7 wherein said sight lines of said operator encompass a an entire vertical height of said work load ranging between a lower side and an upper side thereof.

10. A cabin apparatus as claimed in claim 7 wherein said sight lines of said operator comprise an amplitude of 140 degrees of visual observation.

11. A cabin apparatus as claimed in claim 7 wherein said single cabin comprises, console means for longitudinal, lateral and rotatable movement within said single cabin so as to provide a wide range of peripheral visibility and angles of observation of said work load.

* * * * *